US005127203A

United States Patent [19]

Paquette

[11] Patent Number: 5,127,203

[45] Date of Patent: Jul. 7, 1992

[54] SEISMIC/FIRE RESISTANT WALL STRUCTURE AND METHOD

[76] Inventor: Robert F. Paquette, 970 Edmonds Way, Sunnyvale, Calif. 94087

[21] Appl. No.: 668,760

[22] Filed: Mar. 14, 1991

Related U.S. Application Data

[63] Continuation of Ser. No. 477,620, Feb. 9, 1990, abandoned.

[51] Int. Cl.[5] ..... E04H 1/00

[52] U.S. Cl. ..... 52/241; 52/290; 52/481; 52/690

[58] Field of Search ..... 52/241, 242, 290, 243, 52/481, 690, 238.1, 239, 36, 484

[56] References Cited

U.S. PATENT DOCUMENTS

| | | | |
|---|---|---|---|
| 1,729,439 | 9/1929 | Gordez | 52/241 |
| 3,017,672 | 1/1962 | Vaughan | 52/241 |
| 3,460,302 | 8/1969 | Cooper | 52/290 X |
| 4,805,364 | 2/1989 | Smolik | 52/241 |

OTHER PUBLICATIONS

Sweets Catalog File, 1985, Seebion 6.6/sim, pp. 23–24.

Fire Resistant Design Manual, Gypsum Association, 1984, p. 5.

*Primary Examiner*—Richard E. Chilcot, Jr.

*Attorney, Agent, or Firm*—Flehr, Hohbach, Test, Albritton & Herbert

[57] ABSTRACT

Seismic and fire resistant wall structure and method in which a U-shaped channel member having vertically extending slotted openings in the side flanges thereof is mounted on the underside of a beam or other overhead structural member, with a layer of fire retardant material in the upper portion of the channel. Studs are connected to the channel member with fasteners which pass through the slotted openings and permit relative vertical movement between the channel member and the studs, while holding the studs in place horizontally. Fire retardant wallboard is attached to the opposing side faces of the studs and extends between the floor and the channel member.

9 Claims, 1 Drawing Sheet

SEISMIC/FIRE RESISTANT WALL STRUCTURE AND METHOD

This is a continuation of application Ser. No. 07/477,620 filed Feb. 9, 1990, now abandoned.

This invention pertains generally to wall structures and, more particularly, to a seismic and fire resistant wall structure and method.

Full height non-bearing walls are commonly installed beneath overhead structural members such as roof beams, floor beams, and the like. Such members are commonly constructed in a laminated form commonly known as glue-laminated beams or "glue-lams" and provided with an upwardly convex curvature or crown so that the member will straighten out when subjected to normal loading, e.g. static loads, plastic flow and live loads. Even after the member has straightened out, it may still move because temperature changes, rain loads, and the like.

To accommodate movement of an overhead structural member, a flexible connection is employed between the member and the wall beneath the member. One such connection utilizes a so-called compression track in which the flanges which are connected to the wall studs are bent in bellows-like fashion and thus adapted to flex and permit movement between the structural member and the wall. When flexed, however, these tracks tend to fracture at the bends and fail.

Another flexible connection heretofore provided has a downwardly facing channel in which the upper portion of the wall is loosely received. There is no connection between the channel and the wall, and the wall can become dislodged from the channel if the lower portion of the wall is knocked out of position.

It is in general an object of the invention to provide a new and improved wall structure and method which overcome the limitations and disadvantages of wall structures heretofore provided.

Another object of the invention is to provide a wall structure and method of the above character in which the wall structure is resistant to both seismic loading and fire.

Another object of the invention is to provide a wall structure and method which can be employed economically.

These and other objects are achieved in accordance with the invention by providing an elongated channel member with a base, a pair of side flanges extending from the base and defining a channel, and a plurality of slotted openings at longitudinally spaced intervals in the side flanges, providing a layer of fire retardant material on the side of the base facing the channel, mounting the channel member on the under side of the overhead structural member with the channel opening in a downward direction, positioning a plurality of vertically extending studs between the floor and the channel member with the upper portions of the studs extending into the channel in alignment with the slotted openings, attaching the studs to the channel member with fasteners which pass through the slotted openings and into the studs and permit relative vertical movement between the channel member and the studs, and mounting fire retardant wallboard on opposing side faces of the studs between the floor and the channel member.

Figure 1:
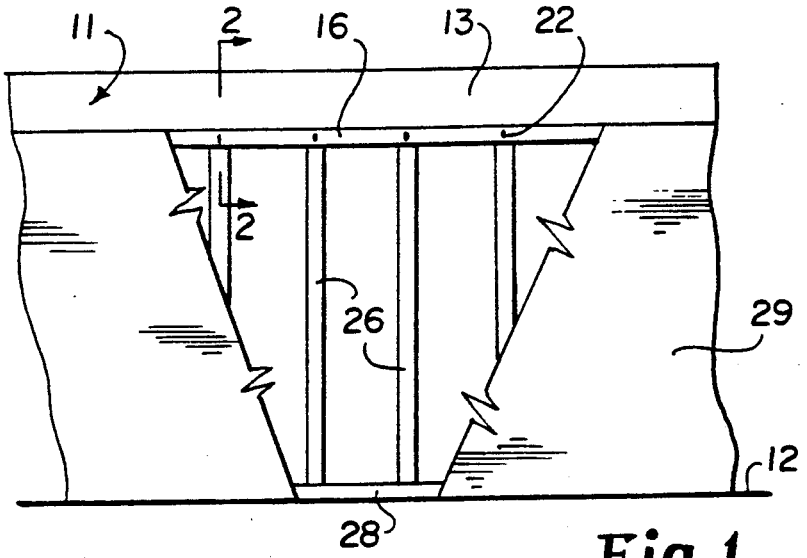
FIG. 1 is a fragmentary side elevational view of a wall structure incorporating the invention.
Figure 2:
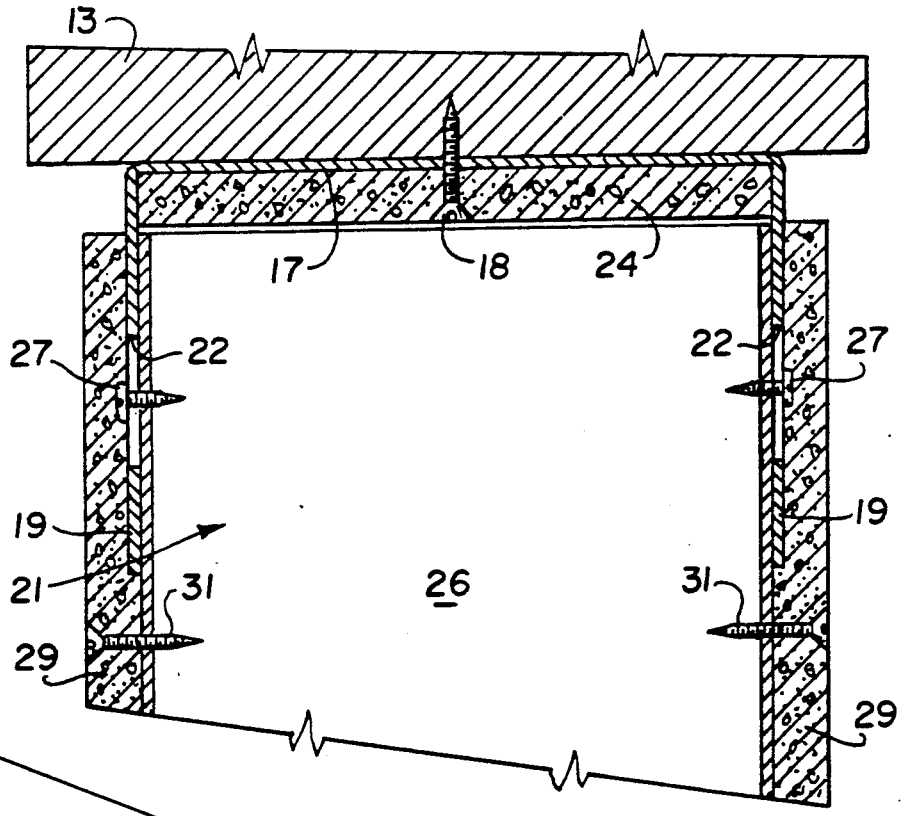
FIG. 2 is an enlarged cross-sectional view taken along line 2—2 in FIG. 1.
Figure 3:
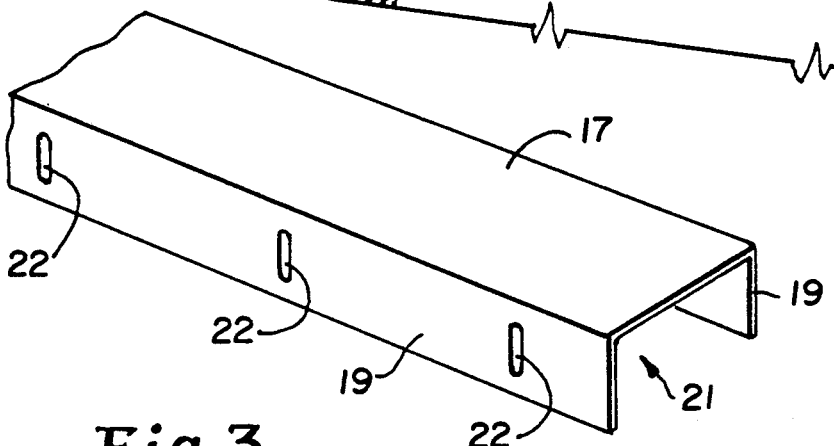
FIG. 3 is a fragmentary isometric view of the channel member utilizing the wall structure of FIG. 1.

As illustrated in FIG. 1, the wall structure 11 is a full height non-bearing wall which is installed between the floor 12 and an overhead structural member 13 such as a roof beam. A fire retardant ceiling 14 conventional construction extends horizontally at a level below the top of the wall.

The wall structure includes a U-shaped channel member 16 of fire resistant material, such as 18 gauge galvanized steel, which is affixed to the underside of beam 13 in an inverted position. The channel member includes a base 17 which is secured to the under side of the beam by screws 18, and a pair of generally parallel depending side flanges 19 which define a downwardly opening channel 21. For standard dimension walls, the channel typically has a width of 2½, 3⅝, 6 or 8 inches and a depth of about 1¼ inches.

A plurality of vertically elongated slotted openings 22 are formed in the side flanges at spaced intervals along the length of the channel member. These slots typically spaced on 8 inch centers, which accommodates standard stud spacings of 16 and 24 inches.

A layer of fire retardant material 24, such as drywall, is affixed to the under side of base 17 in the upper portion of channel 21. In one presently preferred embodiment, the drywall layer is ⅝ inch thick, and it is affixed to the base with an adhesive.

A plurality of studs 26 extend between the floor and the channel member, with the upper end portions of the studs being received in channel 21 and the upper ends of the studs being spaced about ⅛ inch from the lower surface of the fire retardant material 24. The upper end portions of the studs are connected to the channel member by screws 27 which pass through slotted openings 22 and into the studs. The screws are left loose enough to permit them to move freely up and down in the slotted openings thus permit relative vertical movement between the studs and the channel member while anchoring the upper portions of the studs against horizontal movement. The lower ends of the studs are received in and affixed to a U-shaped channel member 28 which is affixed to the floor. In the embodiment illustrated, the studs and the lower channel member are fabricated of a fire resistant material such as metal, and the studs have a generally U-shaped contour in cross-section. If desired, however they can be fabricated of another suitable material, and if, for example, the studs are fabricated of wood, the lower channel can be replaced with a conventional wood floor plate.

Fire retardant wallboard 29 is mounted on the side faces of the studs and extends from the floor to the channel member and over the outside of side flanges 19. The upper edge of the wallboard is spaced about ¾ inch below the lower surface of beam 13 to permit vertical movement between the wall structure and the beam. Although the top ends of studs 26 are spaced only about ⅛ below the lower surface of retardant material 24, they do not interfere with the movement between the studs and the channel member because they cut into the retardant material. If solid studs are used, they should terminate about ¾ inch below the retardant material since they will not cut into it as readily as the U-shaped metal studs. The wallboard is attached to the studs with screws 31, with no screws from the wallboard going into the channel member to interfere with the movement of the studs.

The wall is constructed by mounting the channel member 16 on the under side of the beam, with the slotted openings 22 formed in the side flanges and the layer of fire retardant material 24 installed in the channel. The lower channel member 28 is affixed to the floor beneath the beam, and studs 26 are installed between the channel members in alignment with the slotted openings. The lower ends of the studs are secured to the lower channel member, and screws 27 are installed in the upper ends of the studs through the slotted openings, following which the Wallboard 29 is installed.

It is apparent from the foregoing that a new and improved wall structure and method have been provided. While only certain presently preferred embodiments have been described in detail, as will be apparent to those familiar with the art, certain changes and modifications can be made without departing from the scope of the invention as defined by the following claims.

I claim:

1. In a seismic/fire resistant wall structure installed between a floor and a overhead structural member:

an elongated channel member having a base affixed to the structural member and a pair of side flanges depending from the base and defining a downwardly opening channel;

a layer of fire retardant material extending along the base within the channel;

a plurality of vertically extending slotted openings in the side flanges at spaced intervals along the length of the channel member;

a plurality of studs extending vertically between the floor and the channel member with upper portions of the studs extending into the channel in alignment with the slotted openings;

fasteners passing through the slotted openings and into the studs to anchor the upper portions of the studs against horizontal movement but permitting relative vertical movement between the channel member and the studs; and fire retardant wallboard mounted on the studs and extending from the floor to the channel member.

2. The wall structure of claim 1 wherein the channel member is fabricated of metal.

3. The wall structure of claim 1 wherein the fire retardant material extending along the base of the channel member is wallboard.

4. The wall structure of claim 1 wherein the studs are fabricated of metal.

5. A U-shaped channel member for use in a seismic/-fire resistant wall structure having a plurality of studs extending between a floor and an overhead structural member, with wallboard mounted on opposing side faces of the studs and fasteners connecting upper end portions of the studs to the channel member, said channel member having a base adapted to be fixed to the structural member, a pair of side flanges extending from the base and defining a channel for receiving the upper end portions of the studs, and a plurality of slotted openings formed at longitudinally spaced intervals in the side flanges for receiving the fasteners and permitting relative vertical movement between the channel member and the studs.

6. The channel member of claim 5 including a layer of fire retardant material extending along the side of the base within the channel.

7. The channel member of claim 5 wherein said channel member is fabricated of metal.

8. In a method of constructing a seismic/fire resistant wall structure between a floor and an overhead structural member, the steps of:

providing an elongated channel member with a base, a pair of side flanges extending from the base and defining a channel, and a plurality of slotted openings at longitudinally spaced intervals in the side flanges;

providing a layer of fire retardant material within the channel;

mounting the channel member on the overhead structural member with the channel opening in a downward direction;

positioning a plurality of vertically extending studs between the floor and the channel member with upper portions of the studs extending into the channel in alignment with the slotted openings;

attaching the studs to the channel member with fasteners which pass through the slotted openings and into the studs and permit relative vertical movement between the channel member and the studs so that the studs will not be affected by movement of the overhead structural member on which the channel member is mounted; and mounting fire retardant wallboard on the studs between the floor and the channel member.

9. In a seismic wall structure installed between a floor and an overhead structural member:

an elongated channel member having a base affixed to the structural member and a pair of side flanges depending from the base and defining a downwardly opening channel;

a plurality of vertically extending slotted openings in the side flanges at spaced intervals along the length of the channel member;

a plurality of studs extending vertically between the floor and the channel member with upper portions of the studs extending into the channel in alignment with the slotted openings;

fasteners passing through the slotted openings and into the studs to anchor the upper portions of the studs against horizontal movement but permitting relative vertical movement between the channel member and the studs; and wallboard mounted on the studs and extending from the floor to the channel member.

* * * * *